US009852838B2

(12) United States Patent
Winkler

(10) Patent No.: US 9,852,838 B2
(45) Date of Patent: Dec. 26, 2017

(54) MAGNETIC CORE ELEMENT, MAGNETIC CORE MODULE AND AN INDUCTIVE COMPONENT USING THE MAGNETIC CORE MODULE

(71) Applicant: SUMIDA Components & Modules GmbH, Obernzell (DE)

(72) Inventor: Johann Winkler, Hutthurm (DE)

(73) Assignee: Sumida Components & Modules GMBH, Obernzell (DE)

( * ) Notice: Subject to any disclaimer, the term of this patent is extended or adjusted under 35 U.S.C. 154(b) by 384 days.

(21) Appl. No.: 14/531,006

(22) Filed: Nov. 3, 2014

(65) Prior Publication Data

US 2015/0123761 A1 May 7, 2015

(30) Foreign Application Priority Data

Nov. 5, 2013 (DE) ..... 10 2013 222 435

(51) Int. Cl.
*H01F 27/24* (2006.01)
*H01F 3/00* (2006.01)
(Continued)

(52) U.S. Cl.
CPC ..... *H01F 27/24* (2013.01); *H01F 3/00* (2013.01); *H01F 3/08* (2013.01); *H01F 3/10* (2013.01); *H01Q 7/08* (2013.01)

(58) Field of Classification Search
CPC ... H01F 27/24; H01F 3/00; H01F 3/08; H01F 3/10; H01Q 7/08
See application file for complete search history.

(56) References Cited

U.S. PATENT DOCUMENTS 5,583,387 A 12/1996 Takeuchi et al. ..... 310/217
5,653,422 A 8/1997 Pieloth et al. ..... 251/129.2
(Continued)

FOREIGN PATENT DOCUMENTS

CN 1539188 A 10/2004
CN 201478032 5/2010
(Continued)

OTHER PUBLICATIONS

UK Search Report in corresponding application GB 1419614.1, dated Dec. 4, 2014.
(Continued)

*Primary Examiner* — Mohamad Musleh
(74) *Attorney, Agent, or Firm* — Fattibene and Fattibene LLC; Paul A. Fattibene

(57) ABSTRACT

A rod-shaped magnetic core element, having a first end with a spherical or cylindrical recess or a spherical or cylindrical connecting protrusion, and a second end with a spherical or cylindrical recess or a spherical or cylindrical connecting protrusion so that a bent connection of at least two magnetic core elements is variably adjustable. Magnetic core elements comprising spherical or cylindrical magnetic core ends of this type allow a nearly gap-free construction with little magnetic leakage due to slightly larger end surfaces in comparison with ferrite rods having beveled plane end section surfaces. The enlarged end surface of the spherical surface advantageously allows a more stable connection of individual magnetic core elements without adhesive bonding. This allows the construction of flexible, multiple-member and inexpensive rod core coils and antennae.

24 Claims, 4 Drawing Sheets

(51) Int. Cl.

| | |
|---|---|
| ***H01F 3/08*** | (2006.01) |
| ***H01F 3/10*** | (2006.01) |
| ***H01Q 7/08*** | (2006.01) |

(56) References Cited

U.S. PATENT DOCUMENTS

| | | | | |
|---|---|---|---|---|
| 5,767,816 | A | 6/1998 | Cosman | 343/788 |
| 5,956,073 | A | 9/1999 | Jun et al. | 348/6 |
| 6,556,125 | B1 | 4/2003 | Rohrl | 340/5.62 |
| 7,138,896 | B2 | 11/2006 | Berens et al. | 336/83 |
| 7,961,072 | B2 | 6/2011 | Pilniak et al. | 336/180 |
| 2002/0033777 | A1 | 3/2002 | Maruyama et al. | 343/713 |
| 2003/0066183 | A1 | 4/2003 | Nouzumi | 29/596 |
| 2003/0117251 | A1 | 6/2003 | Haugs et al. | 336/182 |
| 2005/0285708 | A1 | 12/2005 | Berens et al. | 336/212 |

FOREIGN PATENT DOCUMENTS

| | | | |
|---|---|---|---|
| DE | 19861116 | | 8/2001 |
| DE | 10128406 | | 1/2002 |
| DE | 10319674 | | 11/2004 |
| DE | 102005057556 | | 5/2007 |
| DE | 102007007117 | | 8/2008 |
| DE | 102012014572 | | 1/2014 |
| EP | 0629034 | A2 | 12/1994 |
| EP | 0729040 | A1 | 8/1996 |
| EP | 0 629 034 | B1 | 9/1997 |
| EP | 1895549 | A1 | 5/2008 |
| JP | S61-57704 | | 4/1986 |
| JP | H10-214725 | | 8/1998 |
| JP | 2002-261536 | | 9/2002 |
| JP | 2002-319817 | | 10/2002 |
| JP | 2003-079111 | | 3/2003 |
| JP | 2005-098510 | | 4/2005 |
| JP | 2005-522858 | | 7/2005 |
| JP | 2005-260432 | | 9/2005 |
| WO | WO 02/084842 | | 10/2002 |
| WO | WO 02/084842 | A1 | 10/2002 |

OTHER PUBLICATIONS

Chinese Notification dated Feb. 24, 2017 in corresponding Chinese patent application No. 201410617381 and English Translation.

MAGNETIC CORE ELEMENT, MAGNETIC CORE MODULE AND AN INDUCTIVE COMPONENT USING THE MAGNETIC CORE MODULE

FIELD OF THE INVENTION

The present invention relates to a magnetic core element, a magnetic core module and an inductive component using the magnetic core module for the construction of antennae having an improved coverage, in particular antennae for locking and unlocking a motor vehicle, and for the position detection.

BACKGROUND OF THE INVENTION

Wireless electronic locking and unlocking systems are known from the automobile industry. For example, magnetic antennae are installed in automobile door handles, in door frames, side panels or bumpers of motor vehicles, to transmit or receive an electromagnetic signal in order to allow a wireless communication, e.g. for communicating with a transceiver of a key. To accommodate a transmit-receive antenna in a bent door handle the magnetic core is designed, for example, as a rod core of a longitudinal shape, which is formed of several tape-shaped layers of a soft-magnetic metal alloy, wherein the bending tolerance of the layer stack goes from limited to small. Therefore, the core of these antennae may be subjected to stress, resulting in altered magnetic properties if the deformation is too strong, as great tensile forces and compressive forces occur in the material in the layer levels. Moreover, the basis materials of these so-called tape cores are significantly more expensive than those for ferrite cores, and the magnetic losses of more inexpensive, iron-based amorphous cores, as compared to ferrites, are clearly greater at frequencies above 100 kHz. Conventional methods for the production of those antennae using tape cores additionally have the drawback that the stacking of the tapes is relatively complicated.

Antennae with cores made of ferrite rods that have a bent or very long shape are difficult to realize, or not at all, due to the production method. Examples for a bent ferrite core rod are described in DE 101 28 406 B4 and DE 10 2007 007 117 A1. The production of a ferrite core requires the mixing of a presintered magnetic powder with a special plastic injection granulate, which is injected to obtain the desired shape.

In the production of bent or long antennae mechanical strains in the ferrite core rod itself, or external impacts, may result in the breakage of the core, and thus in a deterioration of the magnetic properties. Also, the fabrication of particularly long rod cores having comparatively small core cross-sections is subject to restrictive technical rules, according to which the length of rod cores has to be in a special proportion to the cross-section, respectively, cross-sectional shape. The reasons for this reside in the necessary uniform compression of the magnetic powder, the technically possible stroke of the pressing devices, the mechanical stability during the transport to the sintering devices, the possible strain during the sintering, and the mechanical stability of the finished magnetic ceramics. Thus, it is difficult to produce long rod cores with lengths, for example, of up to 30 cm or more, which would be necessary for a significantly greater coverage of LF antennae with a frequency, for example, of approximately 125 kHz.

For forming a bent or long ferrite core rod it is also possible to connect several core elements having straight or beveled plane end sections to a bent or straight shape. However, configurations of this type have the disadvantage that the adhesive joints of the rod cores glued together could become undone, on the one hand. On the other hand, in the case of a very good bonding strength, the cores can break undefinably even under a small bending load. The air gaps thus created change, respectively, deteriorate the efficiency of the antennae, as compared to an antenna core formed of one piece. Also, ferrite rod core antennae of this type are relatively unstable in terms of magnetism and temperature, and are subjected to great fluctuations in the magnetic stray fields on account of the changing air gaps.

SUMMARY OF THE INVENTION

Against this backdrop it is an object of the invention to provide a magnetic core element which is suited for the cost-efficient production of bendable, respectively, very long rod core antennae with little magnetic leakage. It is furthermore an object of the present invention to provide a magnetic core module as well as an inductive component using the magnetic core module for the construction of flexibly adjustable antennae having a great coverage, and for the construction of long rod core coils having small core cross-sections.

According to the invention, these objects are achieved by the subject matters of the different embodiments of the present invention.

The present invention accordingly relates to a rod-shaped magnetic core element, comprising a first end with a spherical or cylindrical recess or a spherical or cylindrical connecting protrusion, and a second end with a spherical or cylindrical recess or a spherical or cylindrical connecting protrusion, so that a bent connection of at least two magnetic core elements is variably adjustable.

Such a magnetic core element allows a construction of long rod core combinations consisting of several members, which have a minimum internal magnetic shear. In this case, the spherical recess is, for example, a spherical shell, and the spherical connecting protrusion is a spherical head, for forming a cup/sphere end contour.

Preferably, the magnetic core element may comprise a spherical or cylindrical recess or a spherical or cylindrical connecting protrusion at the first end and the second end respectively. A variably adjustable, bent connection of at least two of the magnetic core elements, each having the spherical recess at the first and second ends, is obtained by a sphere of suited material, e.g. ferrite, which is arranged between two so configured rod-shaped magnetic core elements and has a radius corresponding to the recesses. Magnetic core elements comprising a spherical connecting protrusion at the first and second ends respectively are connected to one another by means of a biconcave connecting piece which is made of a suited magnetic material, e.g. ferrite, and includes recesses suited to receive the spherical calottes of the rod-shaped magnetic core elements. A variably adjustable bent connection of at least two of the magnetic core elements, each having the cylindrical recess at the first and second ends, is obtained by a cylindrical connecting piece.

Each of the alternatives allows the construction of multiple-member, nearly air-gap-free core modules having little magnetic leakage, the connecting surfaces of two magnetic core elements having slightly larger surfaces in comparison with ferrite rods the end section surfaces of which are plane. The larger surface area of the spherical or cylindrical surface, as opposed to the plane end section surfaces, advantageously allows a self-guided centering and more stable adhesive bonding when producing a magnetic core module of several magnetic core elements, or a connection of several magnetic core elements with one another without adhesive bonding, by means of axially interlocking them relative to one another, e.g. by using spring elements. The present invention thus allows the construction of long, flexibly adjustable rod cores and rod core coils by means of the above-mentioned spherical or cylindrical end contour.

In a preferred embodiment the magnetic core element has a cylindrical, rectangular, square or elliptical cross-section. Advantageously, the spherical end contour of the magnetic core element is applicable to each of the cross-sectional shapes. Furthermore, depending on the field of application of the rod core coil and/or the structural conditions, e.g. in a motor vehicle, a corresponding cross-section may be chosen.

In a preferred embodiment of the present invention the difference between the diameter of the magnetic core element and the respective diameter of the spherical or cylindrical recess and the spherical or cylindrical connecting protrusion defines a shoulder, the difference being 5% to 10% of the core diameter. This provides for a sufficient angular range for the connection of two magnetic core elements connected to one another, on the one hand, while a high mechanical stability of the magnetic cores in the region of the coupling faces is ensured, on the other hand.

According to another aspect of the present invention this shoulder is beveled.

In another embodiment of the present invention the magnetic core element is formed of a ferrite ceramics or a magnetic powder. The ferrite ceramics includes, for example, manganese-zinc-ferrite or nickel-zinc-ferrite. Using nickel-zinc-ferrite has the further advantage that this material is electrically insulating, while using manganese-zinc-ferrite allows the core, directly wound with a non-insulating conductor, to be coated with an electrically insulating layer.

Another embodiment of the present invention relates to a magnetic core module which is composed of a plurality of magnetic core elements as described above. Thus, variably adjustable, bent connections of at least two magnetic core elements from the plurality of magnetic core elements can be produced with an angle (a). A preferred range of the angle (a) is 0° to 15°. The end shapes of the connected magnetic core elements, which are configured to be matching, allow a construction of long, multiple-member rod core combinations with a minimum internal magnetic shear. Even if the connected magnetic core elements are arranged, for example, in an arcuate way a nearly gap-free construction is realized, so that magnetic stray fields are reduced. Thus, it is possible to create a rod core antenna which is easily adaptable in terms of its shape to a vehicle component, and which has a long service life because it is more insensitive to deformations during installation or use as a result of an improved flexible adjustment.

In another embodiment the present invention relates to an inductive component with the above-described magnetic core module for realizing a rod core antenna. The inductive component is preferably formed without winding carriers, so that the winding is directly applied to the magnetic core module. To this end, the core has to be well insulated, or the core itself has to be made of a Zn—Ni ceramics.

According to further aspects of the present invention the plurality of magnetic core elements are connected to one another by a tension spring system. In this case, the spheres are tensioned in the shells, and the so connected magnetic core elements are held in position by frictional contact. The position can be altered by the application of a force, however. As no adhesive bonding of the cores is necessary the occurrence of air gaps can be prevented and the formation of magnetic stray fields can be reduced.

According to another aspect of the present invention, when connecting at least two magnetic core elements from the plurality of magnetic core elements, a magnetically conducting medium is introduced between the spherical or cylindrical recess and the spherical or cylindrical connecting protrusion, respectively, the connecting sphere or connecting piece at the second end, so as to avoid air gaps occurring when the individual magnetic core elements are connected.

Additional advantageous embodiments of the present invention are defined in the accompanying patent claims. Other embodiments are described in more detail in the following description, with reference to the accompanying drawings.

DETAILED DESCRIPTION OF THE PREFERRED EMBODIMENTS

Figure 1:
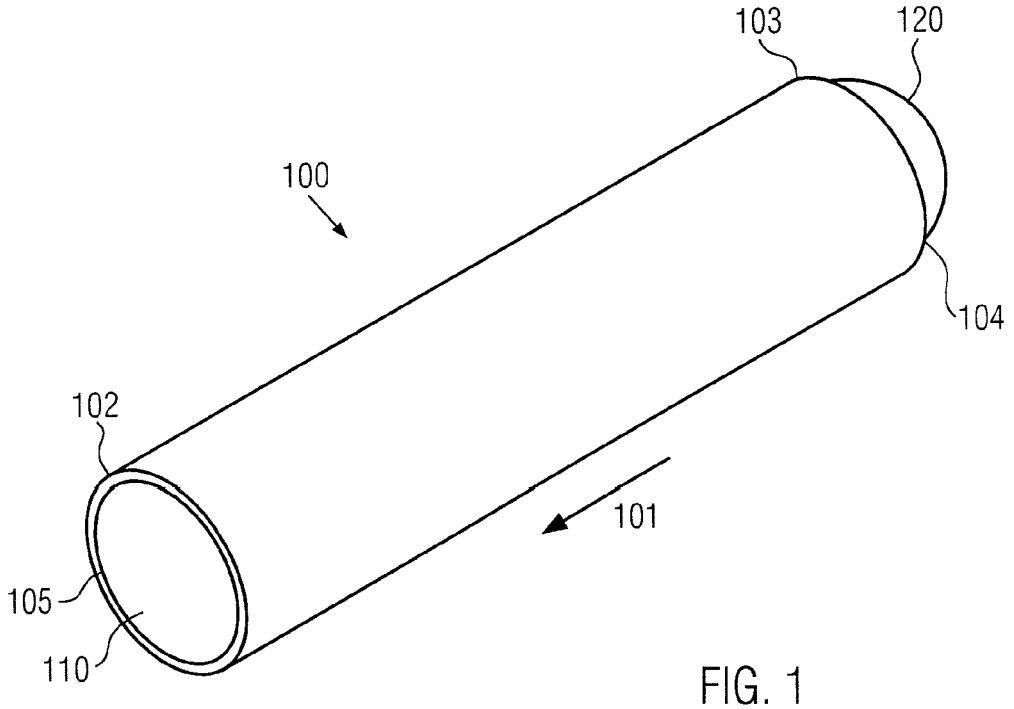
FIG. 1 shows a schematic perspective view of a first embodiment illustrating a magnetic core element of the present invention.

FIG. 1 shows a magnetic core element 100 according to an embodiment of the present invention. The magnetic core element is rod-shaped and defines a longitudinal direction 101, and comprises a first end 102 with a spherical recess 110 and a second end 103 with a spherical connecting protrusion 120, which is suited for the production of a variably adjustable, bent connection of at least two magnetic core elements 100. The core diameter of the magnetic core element 100 is typically 1 mm to 10 mm, and preferably has a length of 10 to 60 mm. It will be appreciated, however, that the dimensions of the magnetic core elements are to be chosen depending on the specific field of application.

In one embodiment of the present invention the spherical recess 110 comprises a spherical shell, and the spherical connecting protrusion 120 comprises a spherical head, to form a cup/sphere end contour. In comparison with a beveled, plane end section surface known in the prior art, the spherical surface of the connecting protrusion has a larger surface area, proving to be advantageous for a variably adjustable, bent connection of at least two magnetic core elements 100. On the one hand, a more stable adhesion between the at least two magnetic core elements 100, respectively, the plurality of magnetic core elements 100 is achieved when same are connected, by which for example the frequency of breakages at the adhesive joints between two magnetic core elements 100 respectively can be reduced. This is a particular advantage as, depending on the intended purpose and structural requirements, a plurality of magnetic core elements 100 can be joined for use in an antenna. A bent connection of at least two magnetic core elements 100, respectively, a plurality of magnetic core elements 100 can be installed, for example, in the handles of motor vehicle doors, in door frames, side panels or bumpers of motor vehicles. On the other hand, the realization of a cup/sphere end contour preferably ensures a connection of the at least two magnetic core elements 100 without adhesive bonding. The bonding of the magnetic core elements without an adhesive will be described in more detail below.

Apart from the kind of stabilizing the end shape of the rod core, composed of several elements, for use in an antenna it should be noted that, when joining at least two or more magnetic core elements 100, it is possible to realize different final antenna configurations due to the cup/sphere end contour. In other words, the magnetic core elements 100 can be joined to form a straight or bent rod core, or to a combination thereof. As the cup/sphere end contour is rotationally symmetric about the longitudinal axis there will be no limitation with respect to the mutual position when connecting at least two magnetic core elements 100. Thus, a rod core joined from several magnetic core elements 100 can adopt different physical shapes.

Another advantage of the spherical magnetic core ends is that, depending on the field of application of the rod core coil and/or the structural conditions of the object of application, e.g. the motor vehicle, magnetic core elements of different lengths can be combined with one another.

The magnetic core element 100 preferably has a cylindrical, rectangular, square or elliptical cross-section. Advantageously, the spherical end shape of the magnetic core element 100 is applicable to any of the cross-sectional shapes. Magnetic rod core elements, in particular those made of ferrite material, advantageously have a round cross-section, as tensions caused in the rod core during production can thus be minimized, as compared to other rod shapes.

Figure 2:
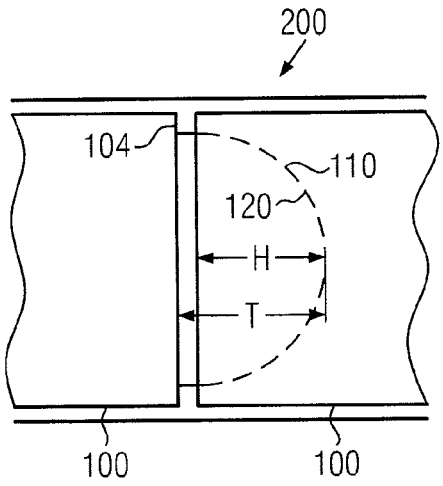
FIG. 2 shows a schematic cross-sectional view of a variably adjustable, bent connection of at least two magnetic core elements according to the present invention.

FIG. 2 shows a schematic cross-sectional view of another preferred aspect or embodiment of the present invention. As shown, the difference between the diameter of the magnetic core element and the diameter of the connecting protrusion defines a shoulder 104. The difference between the diameter of the magnetic core element and the respective diameter of the recess and the connecting protrusion amounts, for example, to 5% to 10% of the core diameter. Forming the shoulder 104 to have a prespecified size allows enough material thickness to be left at the edge of the rod core end region having the recess, so as to obtain a high mechanical stability.

FIG. 2 also shows that a depth (T) of the recess is smaller than a height (H) of the connecting protrusion. Thus, when introducing the second end 103 having the connecting protrusion 120 of the first magnetic core element 100 into the first end 102 having the recess 110 of the second magnetic core element 100, at least two joined magnetic core elements have an annular gap. The ratio of the core diameter to the height of the connecting protrusion is 0.2 to 0.5. For example, the ratio of the core diameter to the height of the connecting protrusion is 0.3. Also, an edge 105, complementary to shoulder 104, is defined between the first end 102 and the recess 110. Depending on this difference between the depth of the recess and the height of the protrusion the maximum tilt of two rod core elements connected to one another is realized without canceling the full-surface contact of the connecting protrusion in the recess.

Different materials are usable as magnetic material for the core, such as a ferrite ceramics, a metal powder or a metal alloy. The ferrite ceramics may be manganese-zinc-ferrite, nickel-zinc-ferrite or the like. Nickel-zinc-ferrite has the advantage that the alloy is electrically insulating, while manganese-zinc-ferrite is electrically conducting on the surface and, in case of a direct winding, allows an additional electrically insulating coating to be provided on the core. The above-described materials are suited in particular as rod cores for filter coils, storage chokes and rod antennae and, depending on the material choice, are particularly applicable for frequencies between 10 kHz to 1000 kHz in the case of manganese-zinc-ferrite, and 0.1 MHz to 10 MHz in the case of nickel-zinc-ferrite.

Figure 3:
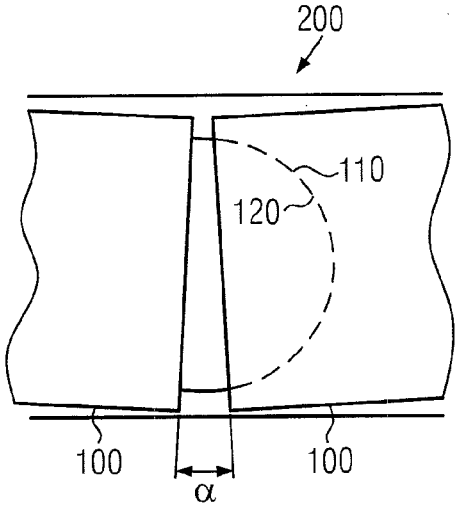
FIG. 3 shows a schematic cross-sectional view of at least two magnetic core elements connected to one another, arranged relative to one another at an angle (a)

FIG. 3 shows a schematic cross-sectional view of another feature of the present invention. The bent connection of at least two magnetic core elements 100, shown enlarged in FIG. 3, has for example an angle ($\alpha$) of 5° at the most. Preferably, the region for the bent connection of at least two magnetic core elements 100 has an angle ($\alpha$) of 0° to 15°.

Figure 4:
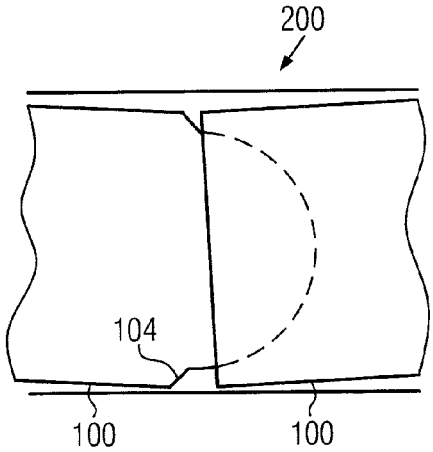
FIG. 4 shows a schematic cross-sectional view of at least two magnetic core elements connected to one another, one magnetic core element including a beveled shoulder.

FIG. 4 shows a schematic cross-sectional view of another preferred aspect of the present invention. In this case, the shoulder 104 is beveled so as to ensure even more flexibility relative to a variably adjustable, bent connection of at least two or more magnetic core elements 100. In another configuration the corner sections of the first end 102 and the second end 103 may be rounded off.

Figure 5:
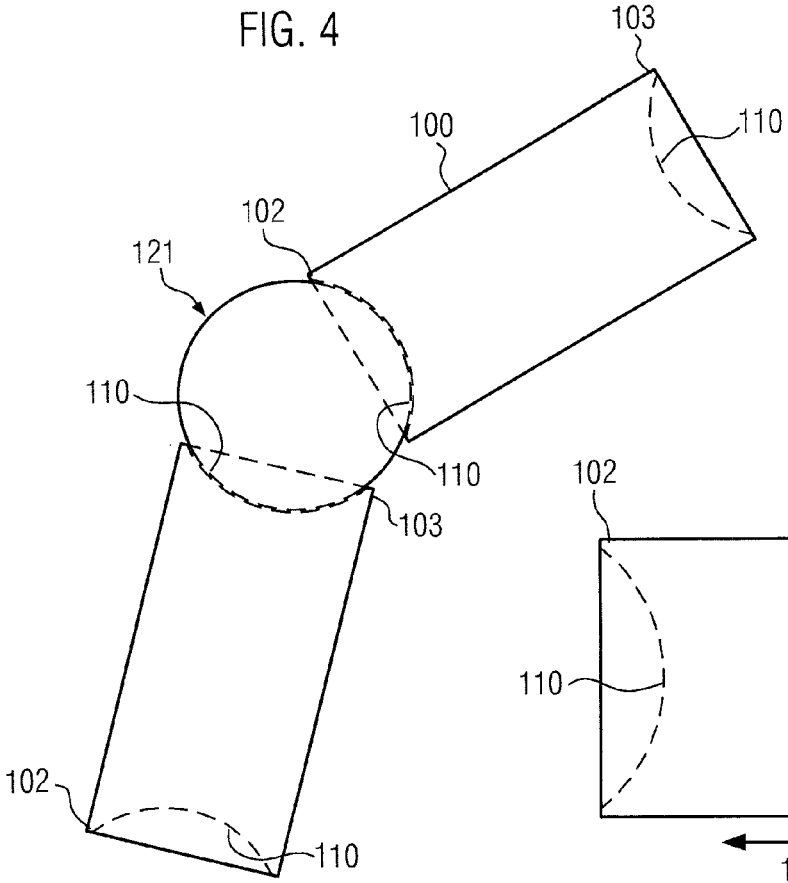
FIG. 5 shows a schematic view of a second embodiment of the present invention.

FIG. 5 shows a second embodiment of the present invention. In this case, the magnetic core element 100 preferably has a spherical recess 110 at the first end 102 and the second end 103 respectively. A variably adjustable, bent connection of at least two of the magnetic core elements 100, each having the spherical recess 110 at the first and second ends 102, 103, is achieved by a connecting sphere 121. Thus, it is possible to realize an even greater mounting angle as compared to the sphere/cup end contour. The use of the connecting sphere, respectively, magnetic sphere 121 furthermore allows the joining of several cores to one nodal point. Thus, for example, three or four magnetic core elements 100 can be connected to one another by one magnetic sphere 121.

Figure 6:
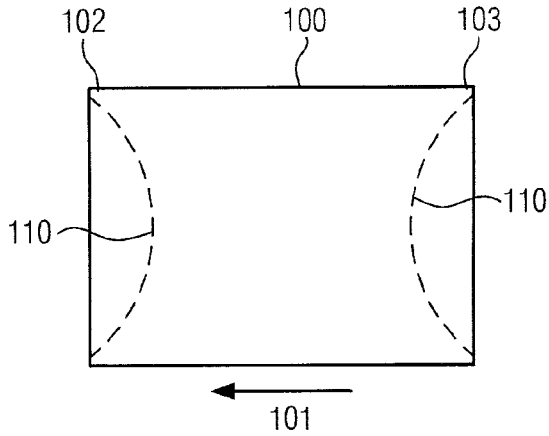
FIG. 6 shows a schematic view of the magnetic core element of the second embodiment of the present invention.

FIG. 6 shows a schematic view of the magnetic core element 100 of the second embodiment of the present invention, which has the spherical recess 110 at its first and second ends 102, 103 respectively. The magnetic core element 100 may furthermore have a spherical connecting protrusion 120 at the first and second ends 102, 103 respectively. A variably adjustable, bent connection of at least two of the magnetic core elements 100, each having the spherical connecting protrusion 120, can be realized by means of a biconcave connecting piece (not shown).

Figure 7:
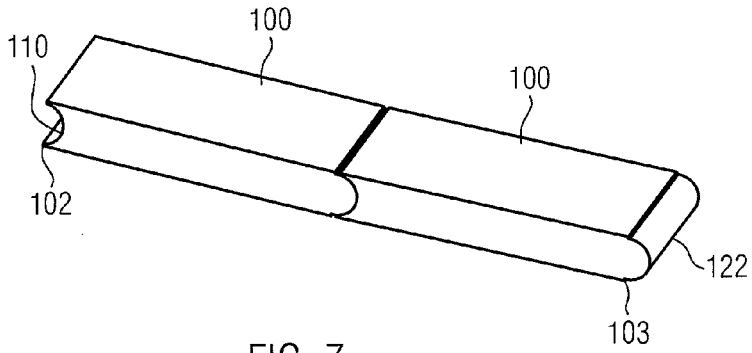
FIG. 7 shows a schematic view of a third embodiment of the present invention.

FIG. 7 shows a third embodiment of the present invention. In this case, the magnetic core element 100, having a rod shape with a rectangular cross-section, preferably has a cylindrical recess 110 at the first end 102 and a cylindrical connecting protrusion 122 at the second end 103. This embodiment is characterized by a very flat design, along with a high magnetic cross-section.

Moreover, the rectangular cross-section may comprise a cylindrical recess 110 at the first and second ends 102, 103 respectively. A variably adjustable, bent connection of at least two of the magnetic core elements 100, each having the cylindrical recess 110 at the first and second ends 102, 103 respectively, is achieved by a cylindrical connecting piece.

Figure 8:
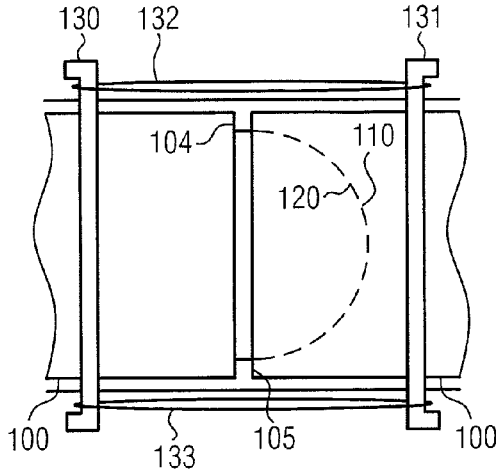
FIG. 8 shows a schematic cross-sectional view of at least two magnetic core elements connected to one another by a tension spring system.

FIG. 8 shows a connection of at least two magnetic core elements 100 by means of a tension spring system. In this case, each magnetic core element 100 includes a holding member 130, 131, which is preferably made of plastic, so as to connect the spherical magnetic core ends 110, 120 to one another by using a rubber ring 132, 133. Thus, centering and contacting is possible by means of the tension spring system, without adhesion, so that, depending on the structural requirements, an extremely flexibly adjustable antenna, respectively, rod core with enough bending capacity is provided.

According to other aspects of the present invention the plurality of magnetic core elements are connected to one another by adhesive bonding. This kind of connection is applicable in cases where no mechanical flexibility is required during operation. By the spherical magnetic core ends 110, 120 it is possible to insert the magnetic core elements of the magnetic core module, e.g. as described above, corresponding to the structural conditions of a motor vehicle door handle into this motor vehicle door handle in a self-centering manner, and glue them together, so that the cores glued together cannot break or become undone at the adhesive joint as mechanical strains are largely prevented.

Figure 9:
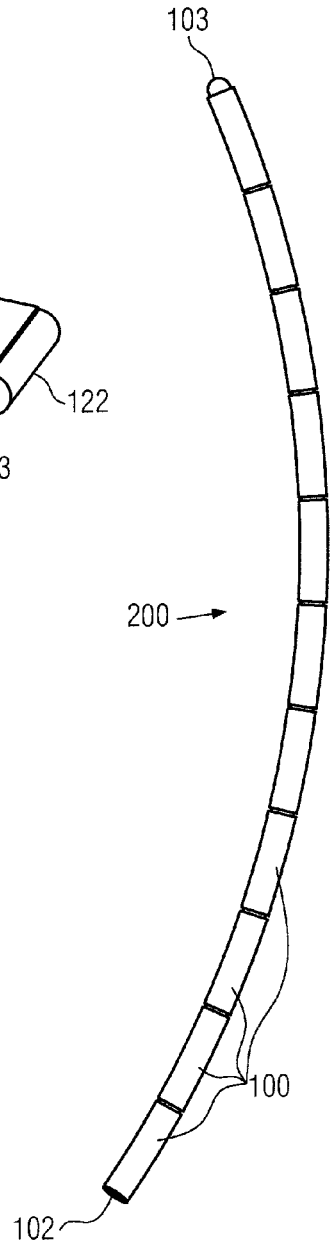
FIG. 9 shows a schematic view of a magnetic core module composed of a plurality of magnetic core elements of FIG. 1.

FIG. 9 shows the individual magnetic core elements 100 connected to one another. FIG. 9 thus illustrates a schematic view of a magnetic core module 200 of the present invention, which is composed of a plurality of magnetic core elements 100. An inductive component may comprise the magnetic core module 200 for realizing a rod core antenna. Also, the inductive component is configured such that the magnetic core can directly serve as a winding body for the coil winding. Thus, for example, a separate winding carrier or coil body may be waived.

The modular design of the magnetic core elements 100 also allows a combination of the different magnetic core materials, e.g. metal powder, sintered ceramics and metal alloy, in a component.

Advantageously, when connecting at least two magnetic core elements from the plurality of magnetic core elements, a magnetically conducting medium is introduced between the spherical or cylindrical recess and the spherical or cylindrical connecting protrusion, respectively, the connecting sphere or the cylindrical connecting piece. The magnetically conducting medium may comprise a paste. On connecting, respectively, joining magnetic core elements made of magnetic powder micro air gaps occur in the joined surfaces as a result of sinter shrinkage tolerances. Air gaps in the connecting surfaces of two magnetic core elements cause a deterioration of the magnetic properties of the rod core module, however. For this reason, it is advantageous to provide a magnetically conducting paste having a defined grain structure in the joint air gap so as to largely avoid these effects. For the production of a magnetically conducting paste it is possible to mix a metal powder having an average grain size of, for example, 100 p or less, with a carrier medium having a thixotropic property.

Figure 10A:
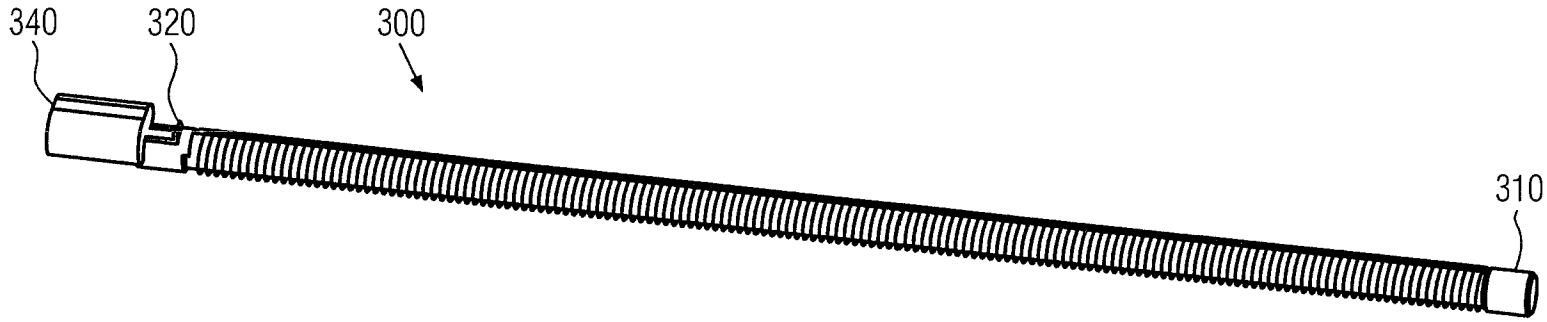
FIG. 10A shows a schematic view of a wound antenna without a housing, and FIG. 10B a cross-sectional view of the wound antenna without a housing illustrated in FIG. 10A
Figure 10B:
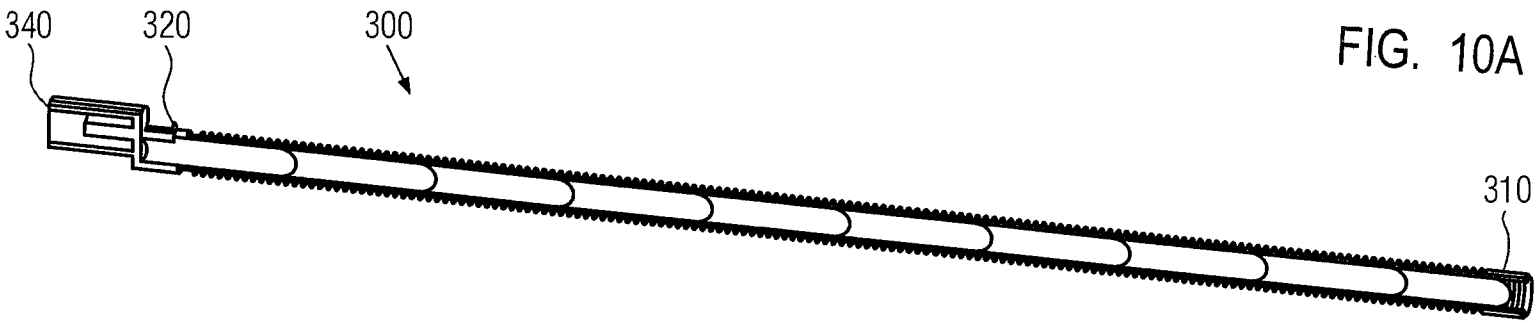

FIG. 10A shows a schematic view of a wound antenna 300 without a housing, and in FIG. 10B a sectional view thereof.

In order to realize the inductive component a thin-walled elastic plastic pipe, having a wall thickness of, for example, 0.3 to 1.0 mm or 0.1 to 0.15 mm, is closed with an end plug 310. Then, the magnetically conducting medium, viz. the magnetic paste, is applied to the spherical or cylindrical recess 110 of the magnetic core elements 100, and the plastic pipe is loaded with the magnetic core elements. In a next step, a pressure spring is introduced into the plastic pipe and closed using an end plug. The plastic pipe is wound with a winding wire, preferably in a continuous operation, the pipe, adapted to advance and rotational speed, being wound along the advance direction and the wire ends being fixed. In this embodiment, the wire itself is used as a contact pin. The wire furthermore defines a bead 320 which engages with a suited recess in a plug-type connector element 340 for being fixed therein. Preferably, the plugs are mounted, and the wires connected, without soldering or welding. Subsequently, the inductance is adjusted by tensioning the spring to a greater or smaller extent, the magnetic core elements thus being shifted relative to the applied winding. Next, a protective pipe, respectively, fixing pipe prefilled with a fixing material is pulled over the inductive component. The so completed inductive component is then subjected to a curing process and a final inspection. Alternatively or additionally, the inductive component may be subjected to an interim inspection during the production process.

Alternatively, to realize the inductive component, it is also possible to insert the magnetic core elements electrically insulated into a helical spring. In case of need, the magnetic paste is applied to the spherical or cylindrical recess 110 of the magnetic core elements 100. The spring then simultaneously serves as a winding and tensioning element. Next, the winding spring is tensioned. Thus, the inductance is adjusted, as was described above. Upon the adjustment the module is fixed, and the spring ends are cut to length. In this embodiment, the wire itself is used as contact pin, and is pressed into the plug housing provided to this end.

Next, a protective pipe, respectively, fixing pipe prefilled with a fixing material is pulled over the inductive component and permanently connected to the plug housing. As described above, this is followed by a curing process and a final inspection.

Thus, according to the invention, the construction of long, multiple-member rod core combinations, having a length, for example, of 30 cm or more, and with a minimum internal magnetic shear, is possible. By realizing a cup/sphere end contour the spherical, respectively, cylindrical surface is provided with a larger surface area, as compared to a plane end section surface according to the prior art. The slightly larger surface area allows a nearly gap-free construction, with reduced magnetic leakage, as compared to a construction having plane end sections. Moreover, it is possible to connect the spherical or cylindrical recess and the spherical or cylindrical connecting protrusion, respectively, the connecting sphere or the cylindrical connecting piece in a more stable manner, without adhesive bonding. Thus, it is possible to produce extremely varied arrangements of long rod core coils, respectively, antennae by means of spherical or cylindrical magnetic core ends of this type. The present invention even allows the realization of long and large chokes for energy storage. In addition, the short magnetic core elements themselves have the advantage that, in the case of an externally applied pressure load, they break more rarely due to their small dimension.

Thus, it is possible to provide an inductive component using the magnetic core module both for the construction of flexibly adjustable antennae having a great coverage and the construction of long rod core coils having small core cross-sections.

A possible application includes, for example, electric cars. A primary coil integrated in the ground at charging stations and a secondary coil accommodated in the car communicate with one another so as to ensure that only suited electric cars, capable of being charged, are parked by charging stations, or to allow an efficient wireless charging. The antennae according to the invention furthermore guarantee a higher sensitivity with respect to the mutual position detection at charging stations.

What is claimed is:

1. Magnetic core module composed of a plurality of rod-shaped magnetic core elements comprising a first end with a spherical or cylindrical recess or a spherical or cylindrical connecting protrusion, and a second end with a spherical or cylindrical recess or a spherical or cylindrical connecting protrusion, so that a bent connection of at least two magnetic core elements is variably adjustable, wherein at least two magnetic core elements from the plurality of magnetic core elements are connected to one another by an elastic connection element providing sufficient force to center and axially interlock the plurality of rod-shaped magnetic core elements together and held in position by friction contact.

2. Magnetic core module according to claim 1, wherein: the magnetic core element has a cylindrical, rectangular, square or elliptical cross-section.

3. Magnetic core module according to claim 2, wherein: a difference between a diameter of the magnetic core element and a respective diameter of the spherical or cylindrical recess and the spherical or cylindrical connecting protrusion defines a shoulder, the difference being 5 to 10% of the diameter of the magnetic core element.

4. Magnetic core module according to claim 3, wherein: the shoulder is beveled.

5. Magnetic core module according to claim 3, wherein: the difference is at least 0.1 mm and at most 4 mm.

6. Magnetic core module according to claim 3, wherein: the ratio of the diameter of the magnetic core element to a height of the connecting protrusion is 0.2 to 0.5.

7. Magnetic core module according to claim 1, wherein: the magnetic core element is formed of a ferrite ceramics, plastic-bonded ferrite or metal powder.

8. Magnetic core module according to claim 7, wherein: the ferrite ceramics includes manganese-zinc-ferrite or nickel-zinc-ferrite.

9. Magnetic core module according to claim 1 wherein: the magnetic core element comprises a spherical or cylindrical recess at the first end and the second end respectively.

10. Magnetic core module according to claim 1, wherein: a variably adjustable, bent connection of at least two magnetic core elements from the plurality of magnetic core elements has an angle ($\alpha$) of at most 5°.

11. Magnetic core module according to claim 1, wherein: a variably adjustable, bent connection of at least two magnetic core elements from the plurality of magnetic core elements has an angle ($\alpha$) of 0° to 15°.

12. Magnetic core module according to claim 1, wherein: at least two magnetic core elements from the plurality of magnetic core elements are connected to one another by adhesive bonding.

13. Magnetic core module according to claim 1, wherein: at least two magnetic core elements from the plurality of magnetic core elements are connected to one another by a tension spring system.

14. Magnetic core module according to claim 1, wherein: at least two magnetic core elements from the plurality of magnetic core elements, each having the spherical recess at the first and second ends, can be connected to one another by a connecting sphere.

15. Magnetic core module according to claim 1, wherein: at least two magnetic core elements from the plurality of magnetic core elements, each having the cylindrical recess at the first and second ends, can be connected to one another by a cylindrical connecting piece.

16. Magnetic core module according to claim 1, wherein: when connecting at least two magnetic core elements from the plurality of magnetic core elements, a magnetically conducting medium is introduced there between.

17. Inductive component comprising a magnetic core module according to claim 1 for realizing a rod core antenna or choke.

18. Inductive component according to claim 17, configured without a winding carrier, wherein a winding is directly applied on the magnetic core module.

19. Inductive component according to claim 17, further comprising:

a metallic spring acting both as winding wire and tensioning element for the individual cores.

20. Inductive component according to claim 19, wherein: the ends of the spring are simultaneously used as pins in a connecting plug.

21. Magnetic core module according to claim 1 wherein: said elastic connection element comprises an elastic tube loaded with the at least two magnetic core elements which is terminated by end plugs and filled with a pressure spring.

22. A magnetic core module comprising:

a plurality of magnetic core elements, each of said plurality of magnetic core elements having a protrusion end and a recess end, the protrusion end complementing the recess end, wherein said plurality of magnetic core elements are aligned end to end with the protrusion ends mating with the recess ends forming the magnetic core module; and a spring system biasing each of said plurality of magnetic core elements towards each other with a biasing force to center and axially interlock said plurality of magnetic core elements together and held in position by frictional contact, whereby each of the plurality of magnetic core elements are centered and contacting each other so that the magnetic core module is capable of being flexible and bending.

23. A magnetic core module as in claim 22 wherein:

said spring system comprises a pair of holding members with the protrusion end and recess end of said plurality of magnetic core elements placed there between and an elastic element biasing the pair of holding members towards each other.

24. A magnetic core module as in claim 22 wherein:

said spring system comprises an elastic pipe loaded with said plurality of magnetic core elements, a spring placed in the elastic pipe, and an end plug closing an end of the elastic pipe.

* * * * *